United States Patent [19]

Xuan

[11] Patent Number: 5,052,614

[45] Date of Patent: Oct. 1, 1991

[54] STRAW AND STRAW HOLE STRUCTURE

[76] Inventor: Jialuo Xuan, 914 Sherman Ave. #2F, Evanston, Ill. 60202

[21] Appl. No.: 597,802

[22] Filed: Oct. 9, 1990

[51] Int. Cl.[5] ..... B65D 77/28

[52] U.S. Cl. ..... 229/103.1; 229/125.15; 220/90.2; 206/217

[58] Field of Search ..... 206/217, 603; 229/1.5 R, 103.1, 123.2, 125.15; 220/90.2, 277; 222/83, 541, 575

[56] References Cited

U.S. PATENT DOCUMENTS

| | | | |
|---|---|---|---|
| 1,243,033 | 10/1917 | Beatty | 229/103.1 |
| 2,943,794 | 7/1960 | Sussman . | |
| 2,979,267 | 4/1961 | Miller . | |
| 3,409,224 | 11/1968 | Harp et al. | 239/33 |
| 3,438,578 | 4/1969 | Peterson et al. | 239/33 |
| 3,524,566 | 8/1970 | Parks | 229/103.1 |
| 3,718,282 | 2/1973 | Pizzoferrato | 239/33 |
| 3,792,798 | 2/1974 | Chang | 220/90.2 |
| 3,822,030 | 7/1974 | Tanzer | 220/90.2 |
| 3,874,554 | 4/1975 | Chang | 220/90.2 |
| 4,121,835 | 10/1978 | Garabedian | 229/103.1 |
| 4,429,828 | 2/1984 | Farber | 229/103.1 |
| 4,438,865 | 3/1984 | Scattaregia | 229/103.1 |
| 4,553,693 | 11/1985 | Terajima et al. | 229/103.1 |
| 4,781,323 | 11/1988 | Elias et al. | 229/125.15 |
| 4,792,069 | 12/1988 | Natin et al. | 229/125.15 |
| 4,792,087 | 12/1988 | Russell | 229/125.15 |
| 4,801,007 | 1/1989 | Rule | 206/217 |
| 4,815,655 | 3/1989 | Jacobsson et al. | 229/123.2 |
| 4,907,722 | 3/1990 | Ueda et al. | 220/277 |

FOREIGN PATENT DOCUMENTS

| | | | |
|---|---|---|---|
| 305789 | 3/1989 | European Pat. Off. | 229/103.1 |
| 327249 | 8/1989 | European Pat. Off. | 229/103.1 |

*Primary Examiner*—David T. Fidei

[57] ABSTRACT

A modified drinking straw having one end with ear-shaped extrados or expanded portion insertable into a modified straw hole on a beverage-containing package consisting of an outer paperboard carrier layer and an inner foil sealing layer to generate necessary air exchange passages between said straw and said sealing layer after inserting said straw into said beverage package, to avoid unexpected and undesired spewing or spraying of drink fluid from the straw by allowing air out when the package compressed under holding finger force. This invention also allows easier drinking due to less sucking effort with the help of the entry air pressure when sucking the beverage. The modification of the straw and the straw hole structure can be easily implemented using the current package manufacturing method and process.

6 Claims, 3 Drawing Sheets

STRAW AND STRAW HOLE STRUCTURE

BACKGROUND OF THE INVENTION

1. Field of the Invention

This invention relates generally to the structure of drinking straws and paperboard packages for beverage usage and more particularly it relates to an improved straw and an improved straw hole on the paperboard package for clean and easy drinking of the beverage by avoiding undesired spewing out of internal beverage fluid from the straw when holding and compressing the package, as well as by allowing less sucking effort when drinking.

2. Description of the Prior Art

Normally, the beverage packages containing various fruit beverages comprise a rectangular shaped paperboard box and a straw attached on the box. The box can be made of a fibrous carrier layer and an aluminum foil layer to seal the fluid, as taught in the U.S. Pat Nos. 4,287,247 (Sept. 1, 1981) and R. 32,956 (June 20, 1989). The straw is a thin-wall thermal plastic tube which is detachable from the box and insertable into the box by using one of its end breaking the aluminum foil layer through a hole on the outside carrier layer. After inserting into the box, the straw is surrounded and hold by both the layers. There is very limited air passage between the straw and the package hole because the hole size is just the same as that of the straw and also the broken portion of the aluminum foil layer will surround the straw wall in a restoring action. Therefore, when people holding such a package with an inserted straw, undesired spewing or spraying may occur occasionally if the holding finger force is large, causing sudden deformation of the package and the internal air has no enough passage to leak out but can only push the beverage fluid to spew out from the straw. On the other hand, when people sucking up the beverage through the straw, there is no enough passage for air flow in, a vacuum pressure is generated inside the package so that the sucking force has to be large. It is obvious both these two aspects are unsuitable, especially for children application.

The prior art includes a variety types of plural straw structure for beverage drinking. The most pertinent references appear to be U.S. Pat. No. 3,409,224 as issured on Nov. 5, 1968 and U.S. Pat. No. 3,438,578 issured on Apr. 15, 1969 which relate to the structure and manufacturing method for flexible drinking straws made of thermoplastic materials.

The U.S. Pat. No. 2,943,794 issured on July 5, 1960 provides a single drinking straw with holes on the straw wall to introduce air into the liquid for beverage aeration.

The U.S. Pat. No. 2,979,267 issured on Apr. 11, 1961 shows a drinking straw arrangement comprising evenly spaced fin-shaped elements on the wall to provide both a spoon and a straw.

The U.S. Pat. No. 3,718,282 issured on Feb. 27, 1973 teaches a two-straw device which transforms noncarbonated beverage into a bubbly effervescent drink by introducing air into the beverage when drinking.

The U.S. Pat. No. 3,792,798 issued on Feb. 19, 1974 teaches straw holes of various shapes on a single-layer liquid container to receive unbendable straws of corresponding cross section shapes.

The European patent No. 305-789-A1 issued on Mar. 8, 1989 discloses an arrangement and method for a suction tube which has at least one foldable portion at its near-middle portion to attach with a conventional drinking container.

Many other U.S. Pat. Nos. 2,815,981, 3,749,312, 4,340,175, 4,657,182, 4,688,721, 4,850,533, and 4,909,437 are representatives of drinking straws that comprising multiple elements to provide flexible and elongatable sucking tubes.

In view of the foregoing, there is a need for an improved straw and straw hole structure on the paperboard beverage packages. Such new straw and straw hole structure should satisfy the following criteria to provide acceptance by users, especially children, using those sealed beverage packages:

1. The straw and straw hole structure should be able to generate a required air passage for necessary air exchange for clean drinking and easy sucking but also such passage will not allow leak of beverage fluid;
2. The straw should be readily insertable into the beverage package through the straw hole in the usual manner without extra or special effort;
3. The straw and the straw hole on the package should be easily manufactured by using the usual production method or process without extra equipment or cost;
4. The straw and the straw hole on the package should have all other functions the same as that of previous straw and straw hole;
5. The straw should have a safe shape unable to hurt the user, especially young children, during packaging, shipping, handling, and drinking.

The criteria are not available from prior patents, thus, they become the objectives of the present invention.

SUMMARY OF THE INVENTION

The present invention comprehends an improved structure for the straw as well as the straw hole on a paperboard carton package, which is sealed by an internal aluminum foil layer, to provide clean and easier drinking. To this end, the invention provides an improved structure of the straw and the straw hole on the package so that an air exchange passage is generated right after inserting the straw into the package through the straw hole. Clean drink is achieved by allowing air flow out of the package through the passage to avoid beverage spewing due to holding and compressing the package. Easier drink is achieved by allowing air flow into the package through the passage to reduce sucking effort due to internal vacuum pressure generated during drinking. The modification of the straw and the straw hole structure includes adding ear-shaped extrados or expended portion at the inserting end of the straw and making notches on the paper-layer hole or enlarging the diameter of the paper-layer hole on the paperboard package. The making of straw and straw hole follows the same standard method or process.

DESCRIPTION OF THE PREFERRED EMBODIMENT

Figure 1:
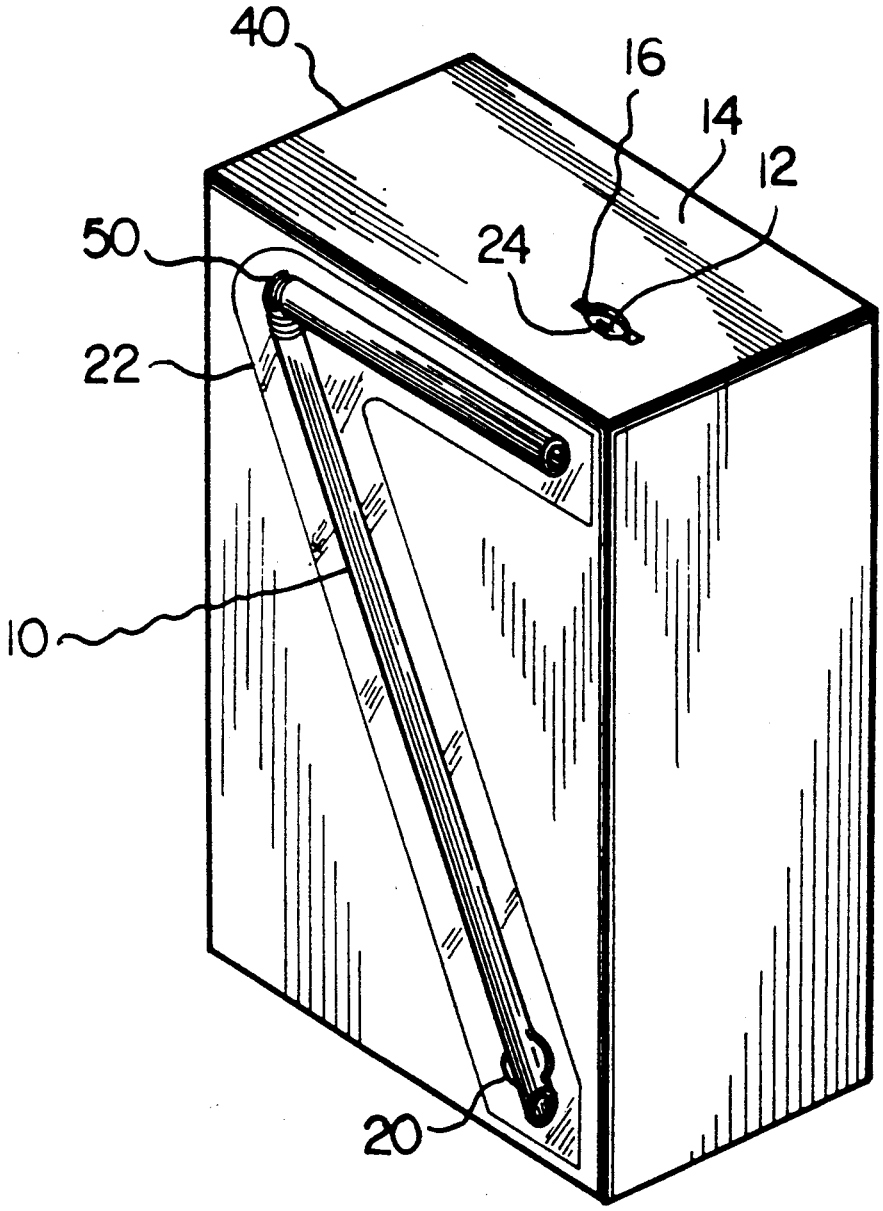
FIG. 1. illustrates a perspective view of the package having ear-shaped straw and notch-shaped straw hole from the present invention.
Figure 2:
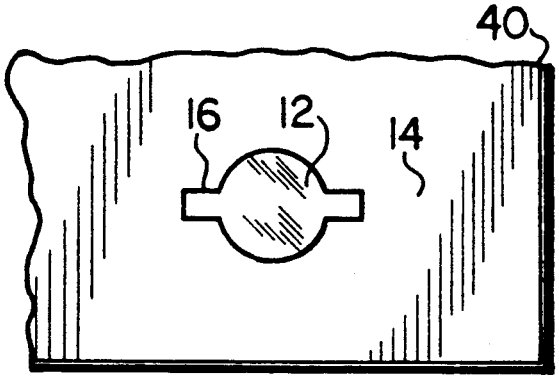
FIG. 2. is a top plan view of the paper-layer straw hole having two notches.
Figure 3:
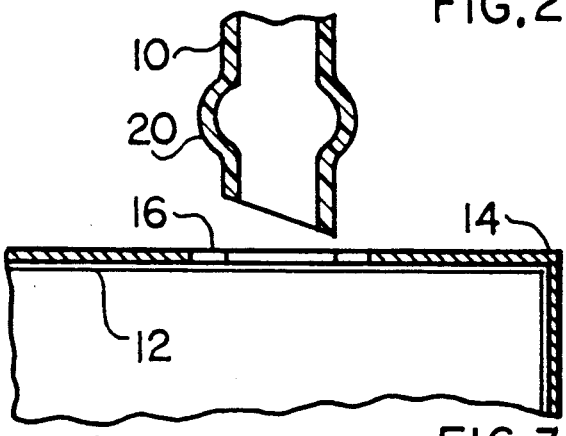
FIG. 3. is a vertical view showing both the inserting end section of an ear-shaped straw and the section of a notch-shaped straw hole on the package involving a paperboard layer and an aluminum foil layer, before insertion.
Figure 4:
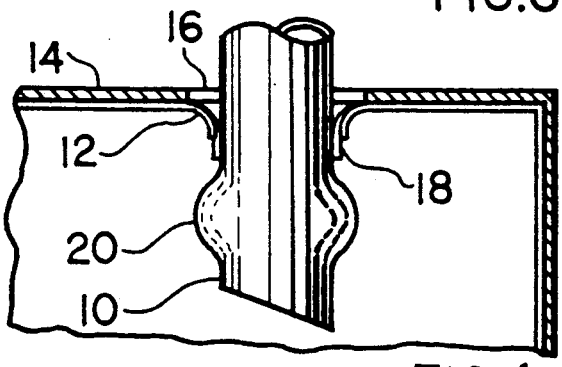
FIG. 4. illustrates the vertical view after inserting the ear-shaped straw into the package through the hole, leaving an air exchange passage at the notch positions.
Figure 5:
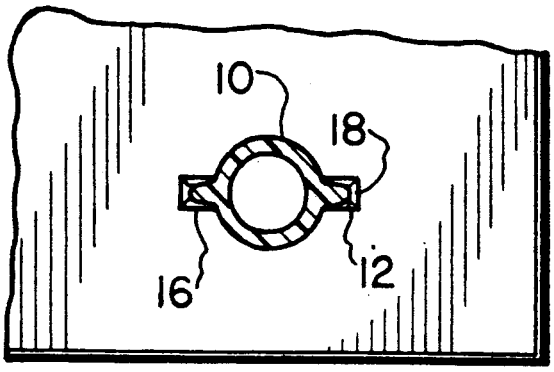
FIG. 5. is a top plan view after inserting the straw in FIG. 4. along lines A—A.

FIG. 1. illustrates a manner in which a thermoplastic thin-wall straw 10, with or without a flexible zone 50, is attached on a beverage package 40 by an adhesive plastic sheet 22. The preferred embodiment of straw 10 has two ear-shaped extrados 20 on its one end that is to be inserted into the package through the straw hole 24. As shown in FIG. 2., the package has a inner sealing layer 12 made by aluminum foil and a outer paperboard layer 14. The preferred embodiment of straw hole 24 on the outer paper layer 14 has a shape of a circle plus two round-shaped or rectangular-shaped notches 16. Through the hole 24 the aluminum foil layer 12 can be seen. The extrados 20 on the straw 10 can be shaped in the same molding process when the straw is made, as shown by the section view in FIG. 3. The sizes of the hole 24 and the notches 16 are a little bit larger than that of the straw 10 and its extrados 20, respectively. Thus, the straw end with extrados 20 can easily break the aluminum foil layer 12 and insert into the package through the hole 24 and notches 16, FIG. 4., leaving two extra openings 18 under the two paper-layer notches 16 to provide the required passage for inside-outside air exchange. Since the aluminum foil layer 12 is flexible and the broken portions of the layer always have an intention to restore their original shapes after the straw passing through, the straw wall will be surrounded by those broken foil portions, also, the two extra openings 18 generated by the two straw extrados will be reduced to such a size and shape shown by FIG. 4. and FIG. 5. that can largely prevent the leakage of internal beverage liquid under normal holding condition but is still enough for air exchange.

The two ear-shaped extrados on the straw have no sharp edges, so such straws can be used safely when drinking and be easily packaged outside the paperboard box 40 with the two extrados parallel to the attaching surface.

When using the straw, it is logical and understandable to insert the straw end with two extrados through the hole with two notches. After inserting, the straw can rotate in the straw hole freely and be supported by the straw hole, just like without these extrados.

Figure 6:
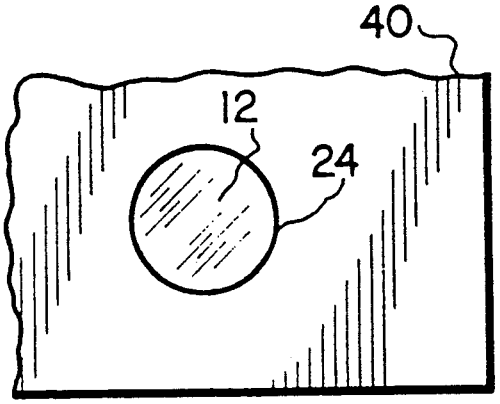
FIG. 6. is a top plan view of the paper-layer straw hole having an enlarged diameter.
Figure 7:
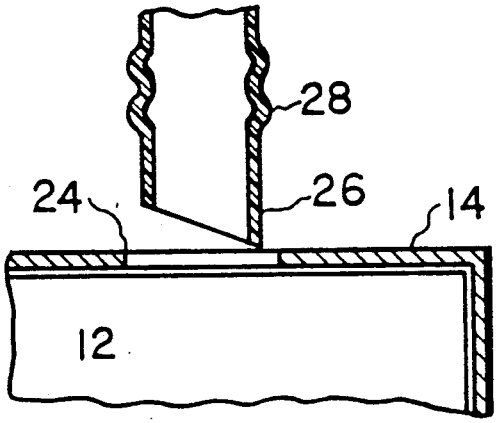
FIG. 7. is a vertical view showing both the expended inserting end section of an straw and the section of straw hole on the package involving a paperboard layer and an aluminum foil layer, before insertion.
Figure 8:
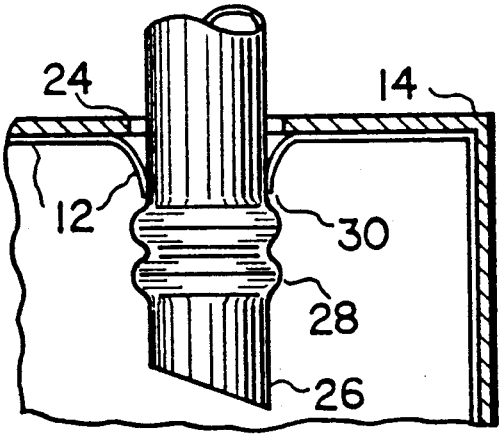
FIG. 8. illustrates the vertical view after inserting the expended straw end into the package through the hole, leaving an air exchange passage at the enlarged paper-layer hole.

Another embodiment of the straw and straw hole structure is to make the straw inserting end 26 having an expended portion 28, FIG. 7., just like the flexible portion of the straw, and accordingly to make the straw hole 24 a little bit larger than the expended portion 28 on the straw, FIG. 6. Such an expended straw end 26 is also easy to be manufactured and will not hurt user in packaging. As shown by FIG. 8., after inserting the straw end 26 through hole 24, a ring-shaped gap 30 is generated between the straw wall and the straw hole. The restoring action by the broken portion of the aluminum foil layer 14 can reduce the size of gap 30 to allow enough air exchange, but the leak of beverage liquid from the ring gap can be largely restricted.

Obviously many other modifications and variations of the present invention are possible in the light of the above teaching. It is, therefore, to be understood that within the scope of the appended claim the invention may be practiced otherwise than as specifically described.

What I claim is:

1. A drinking straw and straw hole structure comprising, in combination:

a beverage containing package having an outer paperboard layer and an inner foil sealing layer, said outer paperboard layer having an opening overlying said inner foil, said opening having a periphery consisting of a first geometrical shape forming a portion of said periphery and at least one second geometrical shape extending outwardly from said first geometrical shape;

a drinking straw having one end adapted to be inserted into said opening, said one end comprising a tubular member with at least one outwardly extending projection, said tubular member having a cross-sectional shape substantially the same as said first geometrical shape with said projection having a cross-sectional shape correspondingly configured for fitting within the periphery defined by said second geometrical shape;

whereby insertion of said one end of said straw into said opening causes the inner foil to rupture to a greater extent than the cross-sectional shape of said tubular member, along said outwardly extending projection, to provide air exchange passages for easy consumption of the package contents.

2. The combination of claim 1 wherein said tubular member has two outwardly extending, diametrically opposed, projections, said opening also consisting of two correspondingly configured, outwardly extending second geometrical shapes.

3. The combination of claim 1 wherein said first geometrical shape is a circle and said second geometrical shape is a rectangle.

4. The combination of claim 2 wherein said first geometrical shape is a circle and said second geometrical shapes are rectangles.

5. The combination of claim 1 wherein said projection is an ear-shaped extrados.

6. The combination of claim 2 wherein said projections are ear-shaped extrados.

* * * * *